US005663479A

United States Patent [19]

Tumiatti

[11] Patent Number: 5,663,479

[45] Date of Patent: Sep. 2, 1997

[54] PROCESS FOR THE CHEMICAL DECOMPOSITION OF HALOGENATED ORGANIC COMPOUNDS

[75] Inventor: Wander Tumiatti, Collega, Italy

[73] Assignee: Sea Marconi Technologies di Wander Tumiatti S.A.S., Turin, Italy

[21] Appl. No.: 454,262

[22] PCT Filed: Dec. 20, 1993

[86] PCT No.: PCT/EP93/03609

§ 371 Date: Jun. 12, 1995

§ 102(e) Date: Jun. 12, 1995

[87] PCT Pub. No.: WO94/14504

PCT Pub. Date: Jul. 7, 1994

[30] Foreign Application Priority Data

Dec. 24, 1992 [IT] Italy ..... MI92A2961

[51] Int. Cl.[6] ..... A62D 3/00

[52] U.S. Cl. ..... 588/206; 208/262.1; 208/262.5; 252/182.12; 252/182.35

[58] Field of Search ..... 588/206; 208/262.1, 208/262.5; 502/414, 401; 252/182.12, 182.35

[56] References Cited

U.S. PATENT DOCUMENTS

| | | | |
|---|---|---|---|
| 4,839,042 | 6/1989 | Tumiatti et al. | 210/194 |
| 5,152,844 | 10/1992 | Wilwerding et al. | 134/25.1 |

FOREIGN PATENT DOCUMENTS

| | | |
|---|---|---|
| 118 858 | 9/1984 | European Pat. Off. . |
| WO91/15558 | 10/1991 | WIPO . |

OTHER PUBLICATIONS

Hackh's Chemical Dictionary, 4th ed., 1969, pp. 26 and 534.
Handbook of Chemistry and Physics, 44th ed., 1962, pp. 444–449, 630, 1018.

*Primary Examiner*—Deborah Jones
*Assistant Examiner*—Amy M. Harding
*Attorney, Agent, or Firm*—Walter H. Schneider

[57] ABSTRACT

Halogenated contaminants are decomposed in a fluid and solid by reacting such matrix with a reagent composed of a non-alkali metal, a polyalkyleneglycol/or Nixolens$^R$ and a hydroxide/or alcoholate. Further, this reagent combined with certain solid carriers forms an immobilized decontamination bed to remove halogenated contaminants continuously from a fluid.

4 Claims, No Drawings

PROCESS FOR THE CHEMICAL DECOMPOSITION OF HALOGENATED ORGANIC COMPOUNDS

The present invention relates to a process for the decomposition of hazardous halogen-containing organic compounds, such as polychlorinated biphenyls.

Numerous halogenated organic compounds, for example, Polychlorinated Dibenzo-p-dioxins (PCDDs), polychlorinated Dibenzofurans (PCDFs), Polychlorinated Byphenyls (PCBs), Dichlorodiphenyltrichloroethane (DDT), 2, 4, 5 trichlorophenol and polyhalogenated alkylbenzene etc., pose definite hazards to the environment and public health. A number of them are resistant to the environmental degradation and remain in hazardous forms for many years.

During the past decade, several methods of disposing of halogenated organic compounds have been proposed, such as incineration, a "secure" landfill and hydrothermal decomposition. However, it has been found that the disposal of such toxic halogenated contaminants with these methods is not satisfactory, especially on a large scale.

Various chemical processes for decomposing halogenated organic compounds have also been developed. Pytlewski and Smith in their U.S. Pat. No. 4,337,368 and U.S. Pat. No. 4,326,090, respectively demonstrated that polyhalogenated organic compounds were found to be decomposed by the reaction with a preformed organosodium reagent, such as sodium naphthalenide, NaPEG. In these cases, the use of metallic sodium metal requires special handling procedures and specialized equipment, and trace amount of water must be eliminated so as to avoid dangerous side reactions.

It has been further proposed by Brunelle of General Electric in U.S. Pat. Nos. 4,351,718 and 4,353,793 that removal of the polychlorinated aromatic hydrocarbon dissolved in an organic solvent, such as transformer oil, can be accomplished by treating the contaminated solution with a mixture of polyethyleneglycol or monocapped polyalkyleneglycol alkyl ether and an alkali metal hydroxide. It has been found that such reactions require extended periods of time to reduce the concentration of halogenated contaminants such as PCBs, to a generally acceptable level.

Also, it has been proposed by Peterson of Niagara Mohawk Power Corporation in U.S. Pat. No. 4,532,028 to reduce the level of halogenated aromatics in a hydrocarbon stream by the treatment with an alkaline reactant in a sulfoxide solvent. This process involves the purification step to remove the sulfoxides solvent after decontamination where the resulting decontaminated fluid will be reused.

In our U.S. Pat. No. 4,632,742 and Eur. Pat. No. 0,118,858, Tundo disclosed a method for the decomposition of halogenated organic compounds by a reagent which consists of (a) polyethyleneglycol, Nixolens®, an alcohol or polyhydroxy compounds, (b) a base, such as alkali or alkaline earth carbonate and bicarbonate, and (c) an oxidizing agent, such as $Na_2O_2$ and $BaO_2$, or a source of radicals in the absence of oxygen. This method is applicable to the decontamination of mineral oil, soil and various porous surfaces. But the use of sodium peroxide, or other oxidizing agents and the source of free radicals pose potential explosion and fire hazards involved in their operation. Also, this can be prohibitively expensive because of the cost of peroxide.

Further, in our U.S. Pat. No. 4,839,042 and Eur Pat. No. 0,135,043 Tumiatti et al described a continuous decontamination process with a dehalogenating bed, which is composed of a polyethylene glycol or a copolymer of various alkene oxides in a certain proportion and an alkali or alkaline earth metal alcoholate, which are adsorbed on certain solid carriers. However, this process was found to require a large amount of reagents and extended periods of time to reduce the concentration of halogenated contaminants such as PCBs, to a generally acceptable level.

The continued efforts to improve our previous patented methods for decontamination of halogenated organic compounds by enhancing its efficiency, reducing decontamination time, operative cost and potential hazards involved in the operation, and improving the recovery of substantial fractions of functional matrix, have led to the development of the present invention.

The present invention provides a process for removing halogenated organic compound from a contaminated fluid and solid matrix. For example, the present invention can be applied to remove polychlorinated biphenyls (PCB) from contaminated transformer oils, e.g. refined asphaltic-base mineral oils, or contaminated heat exchange oils, e.g. hydrogenated terphenyls etc., and the reuse of such fluids can be accomplished very easily after hazardous substances are scavenged from useful materials with the decomposition process of the invention.

It has now been found that halogenated organic compounds can be decomposed rapidly and completely with a reagent consisting of a non-alkali metal, a polyalkyleneglycol/or a Nixolens® and a hydroxide/or an alcoholate. This decomposition reagent overcomes the aforementioned deficiencies of the prior art methods, and gives more effective results than those obtained by using our previous art methods with a reagent produced from an oxidizing agent or a source of radicals.

Non-alkali metals suitable for practicing the present invention are aluminium, iron, magnesium, manganese, nickel, palladium, silicon, titanium and zinc etc. It is suggested to use some specified combinations between these metals such as a mixture of aluminium and titanium. Of these metals, aluminium is particularly preferred metal due to its high reactivity and relatively low cost.

The polyalkyleneglycol which can be used in the practice of the present invention, has the general formula

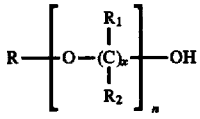

wherein

X is >2 and n is an integer of 1 to 500; R may be hydrogen, a straight or branched-chain $C_1$–$C_{20}$ alkyl group, an aralkyl or an acyl group; $R_1$ and $R_2$ which can be the same or different between each other represent hydrogen, straight or branched-chain alkyl group, possibly substituted $C_5$–$C_8$ cycloalkyl or aryl group.

In addition, Nixolens®, a series of random copolymers of various alkene oxides in different proportions, which is distributed by the Auschem Company of Milano, Italy, is proposed to use in carrying out the present invention because of its high chemicals activities and physical characters. Nixolens®, a common industrial lubricant oil, includes Nixolens®-NS, Nixolens®-VD and Nixolens®-SL. Of them, the preferred is Nixolens®-VS, such as VS-13, VS-40 and VS-2600, which contain a low percentage of propylene oxide monomers and a relatively high percentage of ethylene oxide monomers.

The hydroxide and alcoholate refer to alkali, alkaline-earth metal hydroxide and alkali and alkaline-earth metal $C_2$–$C_6$ alcoholate.

Interestingly, when a polyalkyleneglycol/or a copolymer of various alkene oxides, having an average molecular weight more than 6000, is combined with a non-alkali metal and a hydroxide/or an alcoholate as a decontamination reagent, a very effective elimination result is obtained, especially for lower halogen-content contaminants, such as PCB Aroclor 1242, 1254 and numerous of halogenated alkylbenzenes.

It has been determined in practice that the mole ratio of polyglycol/or Nixolens® to halogen is from 1:1 to 30:1, and the mole ratio of hydroxide/or alcoholate to halogen ranges from 10:1 to 200:1. At this mole ratio, the concentration of the non-alkali metal in the reaction mixture, which consists of the decomposition reagent and contaminated matrix, preferably ranges from about 0.02% to 5% by weight. Surprisingly, the concentration of the non-alkali metal from 0.1% to 2% by weight within the reaction mixture is sufficient to give complete and quick elimination. Specially, when the reagent of the present invention is used to decompose halogenated organic compounds in contaminated solid matrix such as sludge, a relatively large amount of polyglycol/or Nixolens® is employed to serve as both roles of the solvent and the reagent. In general, the amount of the reagent depends upon the type and amount of halide contaminants present.

The reaction temperature can range from about room temperature to 200° C., whereas the temperature in the range of between 70° C. to 120° C. is preferred. The temperature can vary by depending on the nature of various decomposition reagents and the type and amount of halogenated organic compounds to be treated.

The reagent proposed here can be directly mixed with the contaminated fluid or solid matrix having a concentration of halogenated organic compounds from 10 ppm to 300,000 ppm under agitating at a preselected reaction temperature. The agitation of the resulting mixture is important to achieve the best results when the aforementioned reagent has been introduced into the contaminated matrix, especially when relatively low concentration of halogenated contaminants, usually less than 500 ppm, is initially present. It is desirable to carry out the decontamination reaction under an ultrasonic condition. The use of ultrasound in the decontamination process can increase 10–15% of reaction efficiency and decrease 20–25% of decontamination time at least. The use of UV radiations, electric fields and/or microwaves was also found to be advantageous.

The reaction between the aforementioned reactants and halogenated organic compound can be performed in the presence or the absence of air. If desired, the reaction can be run in the presence of an inert gas such as nitrogen. In the practice of the present invention, the relatively high water content of the contaminated matrix has no adverse effect on the reactivity of the decomposition reagent of the present invention.

It has been found that the order of the decomposition process is not considerably critical. Thus, the non-alkali metal, polyalkyleneglycol/or Nixolens® and hydroxide/or alcoholate can be simultaneously or in a certain sequence added to the contaminated matrix. However, the method can be practiced otherwise, for example, the contaminated matrix may be added to the mixture of a non-alkali metal and a polyalkyleneglycol/or a Nixolens®, while or prior to adding of a hydroxide/or an alcoholate.

As a practical matter, using the non-alkali metal in the decomposition reagent can avoid using specialized equipment and special material handling procedures involved in the use of metallic sodium and oxidizing agents such as sodium peroxide, or other sources of free radicals. After the reaction, unconsumed metals precipitate to the bottom of the reactor together with the unconsumed polyalkyleneglycol/or Nixolens® and hydroxide/or alcoholate, and can be readily decanted from the fluid decontaminated. It has also been found that the decontamination effectiveness is largely enhanced by introducing the non-alkali metal into the decomposition reagent instead of oxidizing agents disclosed in our previous art methods, such as sodium peroxide.

Especially, the reagent of the present invention can also be combined together with some solid carriers having a certain particle size and distribution, to become an immobilized bed for continuously removing halogenated organic compounds from contaminated fluids. For example, this continuous process is suitable for the decontamination treatment of processing dielectric fluids without interrupting the operation of the electrical apparatus containing the fluid to be processed.

The solid carriers which can be used in the practice of the present invention are calcium oxide, magnesium oxide, granular aluminium, pumice stone, perlite, diatomite, alkali or alkaline earth metal carbonate and bicarbonate etc. These particles can have a size range of 0.1–10 mm diameter.

Solid carriers can be added to the mixture of a non-alkali metal, a polyalkyleneglycol/or an alkene oxide copolymer and a hydroxide/or an alcoholate in the presence of a solvent, such as alcohol, which then can be removed by evaporation and filtration. Alternatively, polyalkyleneglycols/or alkene oxide copolymers can be added to solid carriers, and mixed under a mild heating (generally lower than 40° C.) so as to get polymers well distributed to solid carriers. The non-alkali metal and hydroxide/or alcoholate are added to this mixture under stirring, and then cooling to room temperature. More simply, solid carriers, non-alkali metal, polyalkylene glycol/or alkene oxide copolymers and hydroxide/or alcoholate can be mixed together in a blender to give a powder or a slurry at room temperature.

The reagents above formed are used to fill a certain device with an appropriate form and size according to the particular application concerned, so as to form an immobilized bed such as a column and a cartridge. Particularly the reagents can be added to the contaminated fluid and pass through a filter to form a porous layer on the septum of the filter to become a filter aid. The filter aid formed in such way is not only a filtering medium which traps the solids from the fluid to be treated, but also gives a decomposition of halogenated organic compounds from the contaminated fluid. The contaminated fluid is continuously passed through the immobilized bed, and this process is a single run or several repeated runs in an open or closed system according to the contaminated level and type of the fluid to be treated. Generally, for transformer oils contaminated by PCBs, the decontamination temperature can range from 20° C. to 150° C.

In order to effectively monitor the decontamination process, a Hewlett Packard Mod. 5890A gas chromatograph with an Ni63 electron capture detector (GC/ECD) is typically used to analyze the halogenated compound content. For example, polychlorinated biphenyls are analyzed by GC/ECD under the following conditions: HP Ultra 2 capillary column packed with cross-linked 5% phenyl methyl silicone gum; injector temperature: 270° C.; detector temperature: 330° C.; column temperature: from 50° C. to 130° C. at the rate of 40° C./min, then 130° C. to 290° C. at the rate of 2.5° C./min; carrier gas: helium; make up gas: argon containing 5 weight percent methane. The concentration of PCBs in the sample is calculated by DCMA method (Dry Color Manufacture's Association), and IEC Method (International Electrochemical Commission) proposed by TC10/WG7 which can identify and quantify the individual (or groups of) congeners. Further, DEXSIL Inc.L2000™ PCB-chloride electrochemical-analyzer can be used for on-site monitoring of the decontamination process at the industrial application, such as mobile decontamination plant.

The following examples further illustrate the invention.

EXAMPLE 1

100 g of clean hydrocarbon-based transformer oil containing approximately 700 parts per million (ppm) of PCBs, was heated to 100° C. in a three-neck flask fitted with an agitator a and a condenser. Thereafter, 0.51 g of aluminium powder, 4.53 g of Nixolens® VS-13 having a molecular weight of about 1000 and 1.89 g of potassium hydroxide in powder form were added to the contaminated oil. The reaction vessel contents were stirred vigorously and maintained at 100° C. throughout the run. Oil samples were periodically taken for PCB analysis. The PCB content was reduced from 700 ppm to less than 2 ppm in 20 minutes.

EXAMPLE 2

The procedure of Example 1 was repeated except the use of ultrasound (ultrasonic intensity, 12.5 $Wcm^{-2}$; ultrasonic frequency, 1 Mhz). After 15 minutes, no detectable PCBs was found in the oil sample.

EXAMPLE 3

100 g of transformer oil containing 8764 ppm of polychlorinated biphenyls was poured into the reaction vessel as indicated in Example 1 and heated to 100° C. 1.7 g of aluminium powder, 30.4 g of Nixolens® VS-13 and 16.5 g of potassium hydroxide were added to the vessel. The reaction vessel contents were agitated and maintained at 100° C. The reaction was carried on for 15 minutes and the oil sample was withdrawn for PCB analysis by IEC method (International Electrotechnical Commission, TC10/WG79 which can identify and quantify individual (or groups of) congeners with PCB congener 30 and 209 as reference peaks for the determination of their Experimental Relative Retention Times (ERRT) and Experimental Relative Response Factors (ERRF). As shown in Table 1, the PCB content was reduced from 8764 ppm to 24 ppm in 15 minutes.

TABLE 1

| PCB | ppm (min) | |
|---|---|---|
| (N. IUPAC) | 0' | 15' |
| 5 8 | — | 7.1 |
| 15 18 | — | 6.1 |
| 17 | — | 1.2 |
| 16 32 | — | 1.8 |
| 26 | — | 1.7 |
| 31 | 8.8 | 2.3 |
| 28 | 12.4 | — |
| 20 21 33 53 | — | 0.1 |
| 39 52 69 73 | 34.4 | 4.3 |
| 44 | — | 0.2 |
| 70 76 96 | 8.9 | — |
| 66 80 88 93 95 102 | 318.3 | — |
| 92 | 52.4 | — |
| 84 | 22.2 | — |
| 89 90 101 | 315.7 | — |

TABLE 1-continued

| PCB | ppm (min) | |
|---|---|---|
| (N. IUPAC) | 0' | 15' |
| 79 99 113 | 11.3 | — |
| 86 97 152 | 16.1 | — |
| 81 87 111 115 116 | 39.9 | — |
| 120 136 148 | 212.5 | — |
| 77 110 | 197.0 | — |
| 151 | 346.8 | — |
| 106 123 149 | 993.0 | — |
| 118 139 140 | 56.5 | — |
| 134 143 | 38.9 | — |
| 114 | 10.5 | — |
| 146 161 165 188 | 124.6 | — |
| 132 153 184 | 948.7 | — |
| 105 127 168 | 173.7 | — |
| 141 | 152.1 | — |
| 179 | 130.6 | — |
| 137 176 | 49.0 | — |
| 138 160 163 164 | 771.3 | — |
| 158 186 | 54.4 | — |
| 126 129 178 | 95.4 | — |
| 166 175 | 34.9 | — |
| 159 182 187 | 305.4 | — |
| 162 183 | 176.9 | — |
| 128 | 54.2 | — |
| 167 | 23.6 | — |
| 185 | 47.5 | — |
| 174 181 | 539.3 | — |
| 177 | 219.0 | — |
| 156 | 133.7 | — |
| 201 | 92.6 | — |
| 204 | 113.3 | — |
| 172 192 197 | 6.8 | — |
| 180 | 902.8 | — |
| 193 | 52.1 | — |
| 191 | 14.7 | — |
| 200 | 21.3 | — |
| 170 190 | 339.0 | — |
| 198 | 7.4 | — |
| 199 | 134.5 | — |
| 196 203 | 91.7 | — |
| 189 | 7.0 | — |
| 195 208 | 81.6 | — |
| 194 | 136.9 | — |
| 205 | 10.3 | — |
| 206 | 22.5 | — |
| TOTAL | 8764.4 | 24.9 |

Table 1 shows that most of PCB congeners found in the initial contaminated oil were destroyed by the reaction with our reagent composed of aluminium powder,(Nixolens® VS-13 and potassium hydroxide in only 15 minutes.

EXAMPLE 4

The procedure of Example 1 was repeated except that the hydroxide was 2.01 g of potassium tertbutylate. The PCB content was reduced from 700 ppm to less than 2 ppm in 30 minutes.

EXAMPLE 5

In order to illustrate the effect of the non-alkali metal of the present invention, a series of comparative tests was conducted employing a non-capped polyalkylene glycol alkyl ether and alkali metal hydroxide reagent system proposed by Brunelle in U.S. Pat. No. 4,353,793.

To the three-neck flask 1 as described in example 1 there were added: 100 g of clean transformer oil containing 646 ppm of PCBs, 2.04 g powdered potassium hydroxide and 3.54 g of polyethylene glycol monomethyl ether having an average molecular weight 350 (PEGM350). Meanwhile there were added to the second volume of such contaminated transformer oil, 0.51 g aluminium powder, 1.53 g powdered potassium hydroxide and 3.53 g PEGM350 in the reaction flask 2 same as flask 1. Both flask contents were agitated with a speed of 600 rpm and kept at 100° C. throughout the run. The reactions proceeded for about 2 hours and the oil samples were withdrawn periodically for PCB analysis. The PCB analysis results are presented in Table 2.

TABLE 2

| | PCB (ppm) | |
|---|---|---|
| Reaction Time (min) | KOH/PEGM350 | Al/KOH/PEGM350 |
| 0 | 646 | 646 |
| 15 | 88 | 2 |
| 30 | 49 | 0 |
| 60 | 20 | 0 |
| 120 | 8 | 0 |

The above results show that the PCB contents were reduced from 646 ppm to 2 ppm with the Al/KOH/PEGM350 reagent in only 15 minutes, while the same removal of PCB's with the KOH/PEGM350 reagent required 2 hours.

EXAMPLE 6

Another series of comparisons between the use of the $Na_2O_2/K_2CO_3$/Carbowax 6000 reagent disclosed in our previous U.S. Pat. No. 4,632,742 and the use of Al/KOH/Carbowax 6000 reagent of the present invention was made to determine the effectiveness of these reagents to remove PCB from non-polar organic solvents.

There was respectively added 100 g of transformer oil contaminated with 560 ppm of PCBs to flask 1 and flask 2 as described in example 1. 0.58 g of sodium peroxide, 3.04 g of potassium carbonate and 4.58 g of solid Carbowax polyethyleneglycol (average M.W. 6000) were added to flask 1. Meanwhile 0.52 g aluminium powder, 3.06 g powdered potassium hydroxide and 4.55 g Carbowax 6000 were added to the flask 2. Each flask contents were agitated and kept at 100° C. throughout the run. Reaction proceeded for 2 hours and samples were taken periodically for PCB analysis. The results obtained are shown in the following Table 3.

TABLE 3

| | ppm PCB | |
|---|---|---|
| Time (min) | Carbowax6000/ $K_2CO_3/Na_2O_2$ | Carbowax6000/ KOH/Al |
| 0 | 560 | 560 |
| 30 | 207 | 68 |
| 60 | 159 | 48 |
| 120 | 105 | 13 |

Table 3 indicates that the Al/KOH/PEG reagent is a more effective reagent for the elimination of PCB contaminants than the $Na_2O_2/K_2CO_3$/PEG reagent.

EXAMPLE 7

Further, a series of comparative tests was performed employing the DMSO/KOH/PEG reagent system as described by Peterson in U.S. Pat. No. 4,532,028.

There were added 2.02 g powdered potassium hydroxide, 3.57 g polyethylene glycol having an average molecular weight of 600 (PEG600) and 1 ml DMSO to 100 g of transformer oil containing approximately 600 ppm of PCB in flask 1. Meanwhile, in flask 2, 2.01 g powdered potassium hydroxide, 3.50 g PEG 600 and 0.44 g aluminium powder were added to the second volume of the transformer oil contaminated with the same PCB's as the oil in flask 1. The flask 1 and flask 2 were the same reaction vessels as indicated in Example 1. Both reactor contents were agitated and kept at 90° C. throughout the run. The reactions were carried on for 2 hours and oil samples were withdrawn periodically for PCB analysis. The results are presented in Table 4:

TABLE 4

| Reaction Time | ppm PCB | |
|---|---|---|
| (min) | KOH/PEG600/DMSO | Al/KOH/PEG600 |
| 0 | 600 | 600 |
| 15 | — | 175 |
| 20 | 219 | — |
| 30 | 143 | 74 |
| 60 | 66 | 31 |

EXAMPLE 8

In order to illustrate the effect of different non-alkali metals on the process of present invention, a series of reactions was performed. In one reaction vessel as described in Example 1, there were added 0.54 by weight of aluminium powder, 1% by weight of potassium hydroxide powder and 3% by weight of PEGM350 to 100 g of transformer oil containing approximately 600 ppm of PCBs. The resulting heterogeneous mixture was stirred and maintained at 95° C. The reaction proceeded for 15 minutes and the oil was removed and analyzed for PCB content.

The above procedure was repeated employing calcium, iron, magnesium, manganese, nickel, tin, silicon and zinc respectively. The results are presented in Table 5.

TABLE 5

| Metal (wt %) | PEGM350 (wt %) | KOH (wt %) | % Reaction |
|---|---|---|---|
| Al (0.50) | 3.11 | 1.07 | 95.1 |
| Ca (0.50) | 3.03 | 1.02 | 83.2 |
| Fe (0.58) | 3.08 | 1.06 | 81.7 |
| Mg (0.53) | 3.03 | 1.06 | 94.5 |
| Mn (0.54) | 3.09 | 1.03 | 93.3 |
| Ni (0.51) | 3.04 | 1.06 | 85.5 |
| Sn (0.57) | 3.03 | 1.07 | 81.3 |
| Si (0.53) | 3.00 | 1.06 | 92.8 |

EXAMPLE 9

To an Erlenmeyer flask with a magnetic stirrer/hot plate system, there was added 10 grams of sludge contaminated with $Cl_{(1-4)}$—$C_{(1-4)}$-alkylbenzene 22.4 mg/g), $BrCl_{(1-2)}$—$C_{(1-3)}$-alkylbenzene (0.2 mg/g), Br—$C_3$-alkylbenzene (0.2 mg/g), $Cl_{(3-5)}$-biphenyl (3.9 mg/g) and $Cl_6$-benzene (<0.01 mg/g), which was provided by Center For Industrial Research of Oslo in Norway. 19.89 g of diethylene glycol was added to the flask and heated to about 85° C. 0.62 g of aluminium powder and 4.28 g of powdered potassium hydroxide were added to the flask while the flask contents were stirred. The reaction contents were agitated for 20 hours and the temperature was kept at 85° C. Following the reaction, the flask contents were filtrated and the sludge was air-dryed and submitted for the analysis of halogenated organic compound content. The analysis results showed that there was no detectable halogenated organic compounds found in the sludge.

EXAMPLE 10

6.77 g Carbowax 6000, 0.26 g aluminium powder, 5.90 g potassium hydroxide and 31.37 g pumice-stone (PUMEX ; from LIPARI island, Italy) were mixed in a blender for 1 minute, and then charged into a column (20 mm, h 280 mm) thermostated at 85° C. 102.97 g of mineral oil containing 816 ppm of PCB passed through the column at a flow rate of 65 ml/h. The effluent oil from the column was collected in a clean vessel. After one cycle, the oil sample was taken for PCB analysis, and the analysis result indicated that the PCB content had been reduced to 8.8 ppm.

While certain representive embodiments and details have been shown for the purpose of illustrating the invention, it will be apparent to those skilled in this art that various changes and modifications may be made therein without departing from the scope of the invention.

I claim:

1. A process for the decomposition of a halogenated compound which comprises subjecting a fluid or solid matrix contaminated with said halogenated compound to a reagent consisting of (a) at least one non-alkali metal selected from aluminum, calcium, iron, magnesium, manganese, nickel, palladium, silicon, tin, titanium and zinc; (b) an alkali or alkaline earth metal hydroxide or an alkali or alkaline earth metal $C_1$–$C_6$ alcoholate; and (c) a polyalkylene glycol or a random copolymer of ethylene and propylene oxides; and stirring at a temperature from ambient to 200° C.

2. A process according to claim 1 in which the halogenated compound is PCB, PCDD, PCDF, DDT, or DDE.

3. A process according to claim 1 in which the mole ratio by said polyalkylene glycol or random copolymer of ethylene and propylene oxides to the halogen of said halogenated compound is 1:1 to 30:1; the mole ratio of said hydroxide or alcoholate to said halogen is 10:1 to 200:1; and the non-alkali metal is present in about 0.02–5.0% by weight of the combined weight of the matrix and reagent.

4. A process according to claim 1 in which the non-alkali metal is aluminum or a mixture thereof with titanium.

* * * * *